US009233045B2

(12) United States Patent
Lynch

(10) Patent No.: US 9,233,045 B2
(45) Date of Patent: Jan. 12, 2016

(54) MEMORIAL URN

(71) Applicant: Lindsay Lynch, Casselberry, FL (US)

(72) Inventor: Lindsay Lynch, Casselberry, FL (US)

( * ) Notice: Subject to any disclaimer, the term of this patent is extended or adjusted under 35 U.S.C. 154(b) by 0 days.

(21) Appl. No.: 14/599,747

(22) Filed: Jan. 19, 2015

(65) Prior Publication Data

US 2015/0128391 A1 May 14, 2015

Related U.S. Application Data

(63) Continuation-in-part of application No. 13/938,481, filed on Jul. 10, 2013, now Pat. No. 8,959,731.

(51) Int. Cl.

| | |
|---|---|
| ***A61G 17/08*** | (2006.01) |
| ***E04H 13/00*** | (2006.01) |
| ***F21V 35/00*** | (2006.01) |

(52) U.S. Cl.

CPC ..... *A61G 17/08* (2013.01); *E04H 13/008* (2013.01); *F21V 35/00* (2013.01); *A61G 2205/30* (2013.01); *A61G 2205/50* (2013.01)

(58) Field of Classification Search

CPC . A61G 17/08; A61G 17/007; A61G 2205/30; A61G 2205/50; F21V 35/00; E04H 13/008

USPC ..... 27/1, 35; D99/5; 52/128, 134, 136; 211/85.27; 40/124.5; 431/288, 291, 431/298

See application file for complete search history.

(56) References Cited

U.S. PATENT DOCUMENTS

| | | | | |
|---|---|---|---|---|
| 5,683,239 | A | 11/1997 | Cardosi | |
| 5,813,098 | A | 9/1998 | Schneider | |
| 6,023,822 | A * | 2/2000 | Luebke | 27/1 |
| 6,161,268 | A | 12/2000 | Joseph | |
| 6,520,606 | B1 | 2/2003 | Robinson | |
| 6,785,939 | B1 | 9/2004 | James | |
| 6,904,721 | B1 | 6/2005 | Forbes | |
| 7,036,195 | B2 | 5/2006 | Glass | |
| 7,174,611 | B1 | 2/2007 | Rose et al. | |
| 7,178,209 | B1 * | 2/2007 | Radziewicz | 27/1 |
| 7,562,423 | B2 * | 7/2009 | Pryd-Kakuk | 27/1 |
| 7,987,564 | B2 | 8/2011 | Leeder | |
| 8,046,881 | B2 | 11/2011 | Johnson et al. | |
| 8,146,216 | B2 | 4/2012 | Creager | |
| 8,627,555 | B2 * | 1/2014 | Kennedy | 27/1 |
| 2006/0179623 | A1 | 8/2006 | Robinson | |
| 2010/0043187 | A1 | 2/2010 | Steuer et al. | |
| 2014/0047683 | A1 * | 2/2014 | Cooke et al. | 27/1 |

* cited by examiner

*Primary Examiner* — William Miller

(74) *Attorney, Agent, or Firm* — Jason T. Daniel, Esq.; Daniel Law Offices, P.A.

(57) ABSTRACT

A memorial urn includes a central core having at least one vessel stored therein, the vessel functioning to house and identify cremated remains. A protective outer shell having a one or more commemoratory items is positioned about the core. One or more lighted elements illuminates the outer body, and a candleholder is positioned onto the outer body. A base unit is removably secured to the bottom of the outer shell.

18 Claims, 9 Drawing Sheets

MEMORIAL URN

CROSS-REFERENCE TO RELATED APPLICATIONS

This application is a continuation-in-part of, and claims the benefit to copending U.S. application Ser. No. 13/938,481 filed on Jul. 10, 2013, the contents of which are incorporated herein by reference.

TECHNICAL FIELD

The present invention relates generally to urns, and more particularly to a memorial urn which can be customized to celebrate the life of a loved one.

BACKGROUND

The statements in this section merely provide background information related to the present disclosure and may not constitute prior art.

Since the dawn of recorded history, man has endeavored to maintain a link between themselves and their deceased loved ones. This is typically accomplished through the use of a memorial such as a headstone, statue, or other such monument. These monuments are typically located adjacent to the burial site of the deceased, and serve as a permanent reminder to the legacy of a loved one. However, owing to increased concern for health conditions around cemeteries, the ever-increasing costs of earth burials, and the increasingly scarce availability of burial space, cremation has become a widely popular alternative to the more traditional whole-body interment.

To this end, the cremated remains of an individual are typically placed within a vessel such as an urn, for example, prior to being returned to a family member or loved one. At this point, the family members must decide what to do with the ashes. For example, many cemeteries offer patrons the option of purchasing a burial space that is specifically designed for the internment of cremated remains, while other families choose to scatter the ashes of their loved ones. Still, others opt to remember their loved ones by keeping the urn containing the cremated ashes in their homes.

However, until now these urns have been generally unsatisfactory because they are readily identifiable as an urn, offer mere token customization options, and do not generally convey a suitable and enduring monument to the departed which can remain with families for generations to come.

Accordingly, the need exists for a memorial urn which can be custom crafted to create a unique and lasting tribute to a loved one that includes a sealed compartment for securely and permanently housing the cremated remains.

SUMMARY OF THE INVENTION

The present invention is directed to a memorial urn. One embodiment of the present invention can include a central core having at least one vessel stored therein, the vessel functioning to house and identify cremated remains. A plurality of commemoratory items can be removably secured to a protective outer shell that can be positioned about the core. One or more lights can illuminate the outer body, and a candleholder can be provided onto the outer body so as to receive one or more candles. The outer shell can be positioned onto a removable base unit which can be interchangeable with other protective shells.

Another embodiment of the present invention can include various base holders having a plurality of different shapes, sizes and connectors. Each of the base holders can include various indicia, commemoratory items and lights.

Yet another embodiment of the present invention can include a plurality of vessels stored within the central core.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
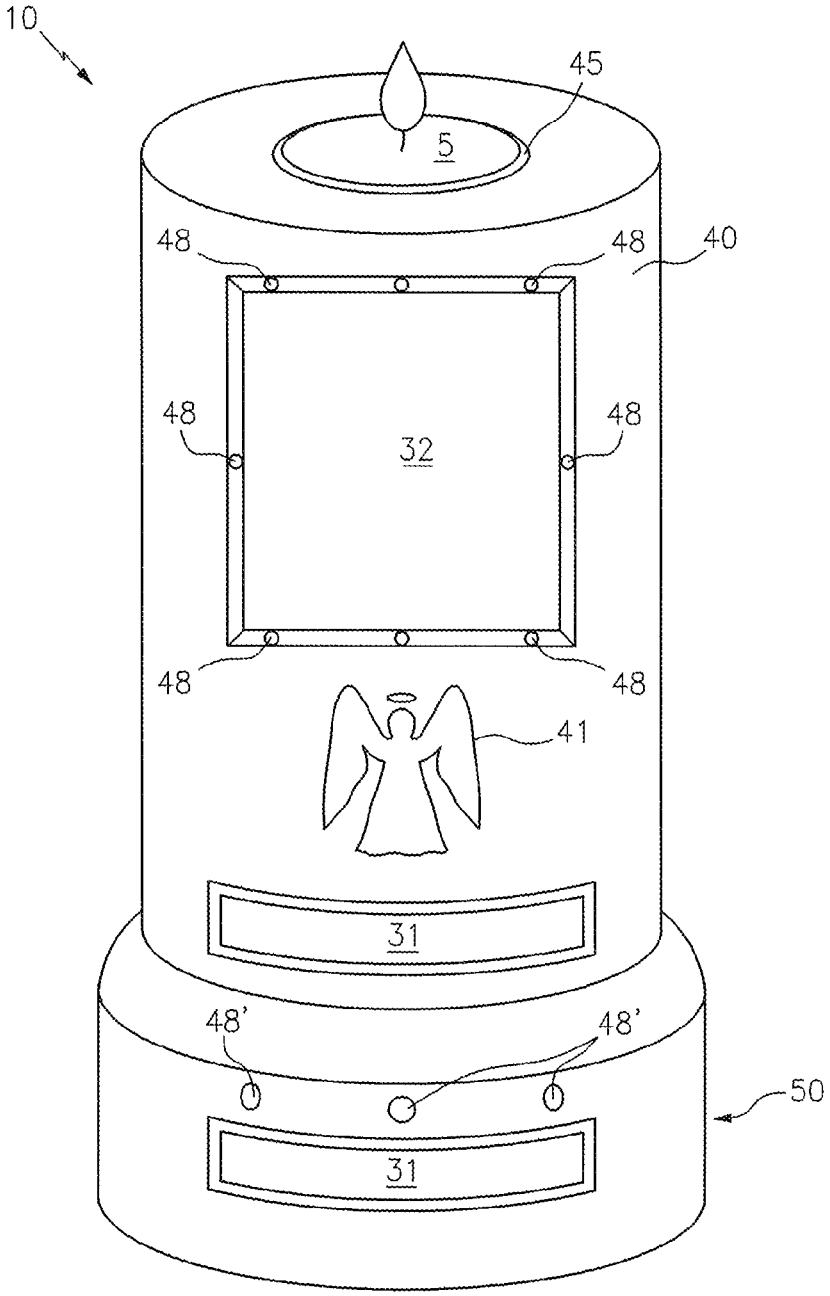
FIG. 1 is a perspective view of a memorial urn in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Although described throughout this application as pertaining to human remains, the inventive concepts disclosed herein are equally applicable to nonhuman remains, without limitation.

FIG. 1 illustrates one embodiment of a fully assembled memorial urn 10 that is useful for understanding the inventive concepts disclosed herein. As will be described below, the memorial urn 10 can include a central core 20, one or more containment vessels 25, an outer body 40, a candleholder 45 and a base 50 that can be removably secured to the outer body.

Figure 2:
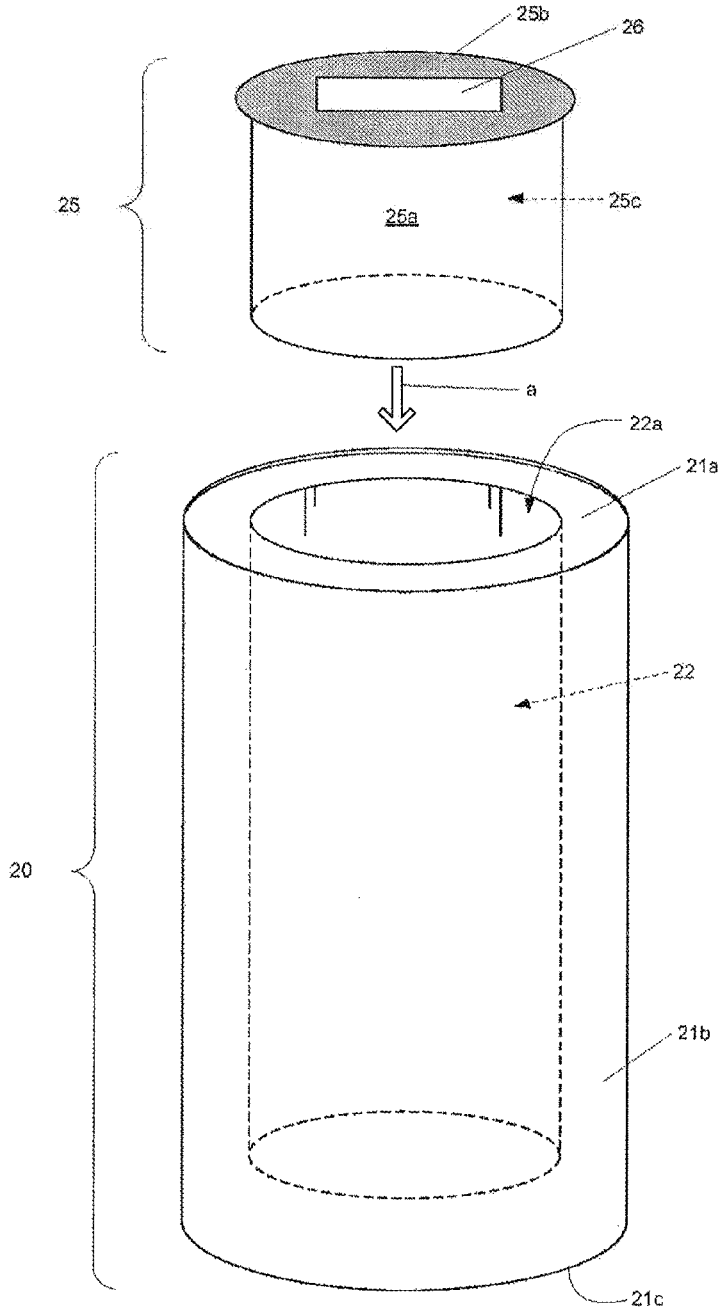
FIG. 2 is an exploded parts view of a central core and a vessel of the memorial urn, in accordance with one embodiment of the invention.

As shown in FIG. 2, the central core 20 can preferably include a generally cylindrical construction having a top end 21*a*, a middle section 21*b* and a capped bottom end 21*c*, that is constructed from a fire retardant and scatter proof plastic. An elongated open ended channel 22 can extend downward from the top end 21*a*, and can function to receive and hold one or more vessels 25 (see arrow a) containing the cremated remains.

Although described with respect to a particular shape and/or material, those of skill in the art will recognize that the core 20 can be constructed from any number of conventional materials capable of being produced to any desirable size and shape, these materials including, for example, plastic, metal and/or composite materials.

The vessel 25 can preferably include a generally cylindrical main body 25*a* and a permanent or removable lid section 25*b* defining a generally waterproof and airtight chamber 25*c* for receiving and permanently storing cremated ashes. A permanent label 26, engraving, or other such marking can be secured along one end of the vessel 25 to provide information pertaining to the deceased, such as name, date of birth, and date of death, for example.

Although described as including a single vessel, this is for illustrative purposes only. To this end, the central core can function to receive between approximately 1 and 3 individual vessels 25, each having any number of different shapes and sizes that are suitable for being housed within the elongated channel 22 of the central core. Moreover, the vessel 25 can be constructed from any number of sturdy materials such as plastic, composites, and metals such as steel and aluminum, for example. Additionally, the lid 25*b* can be hermetically and permanently affixed to the main body 25*a* via welds, or through the use of adhesives. By permanently sealing the ashes within a secure vessel having a non-removable identification device 26, the inventive concepts advantageously provide security to a loved one that, in the unlikely event the main body 20 and/or outer shell 40 is ever ruptured or otherwise damaged, the ashes and vessel 25 will remain intact.

Figure 3:
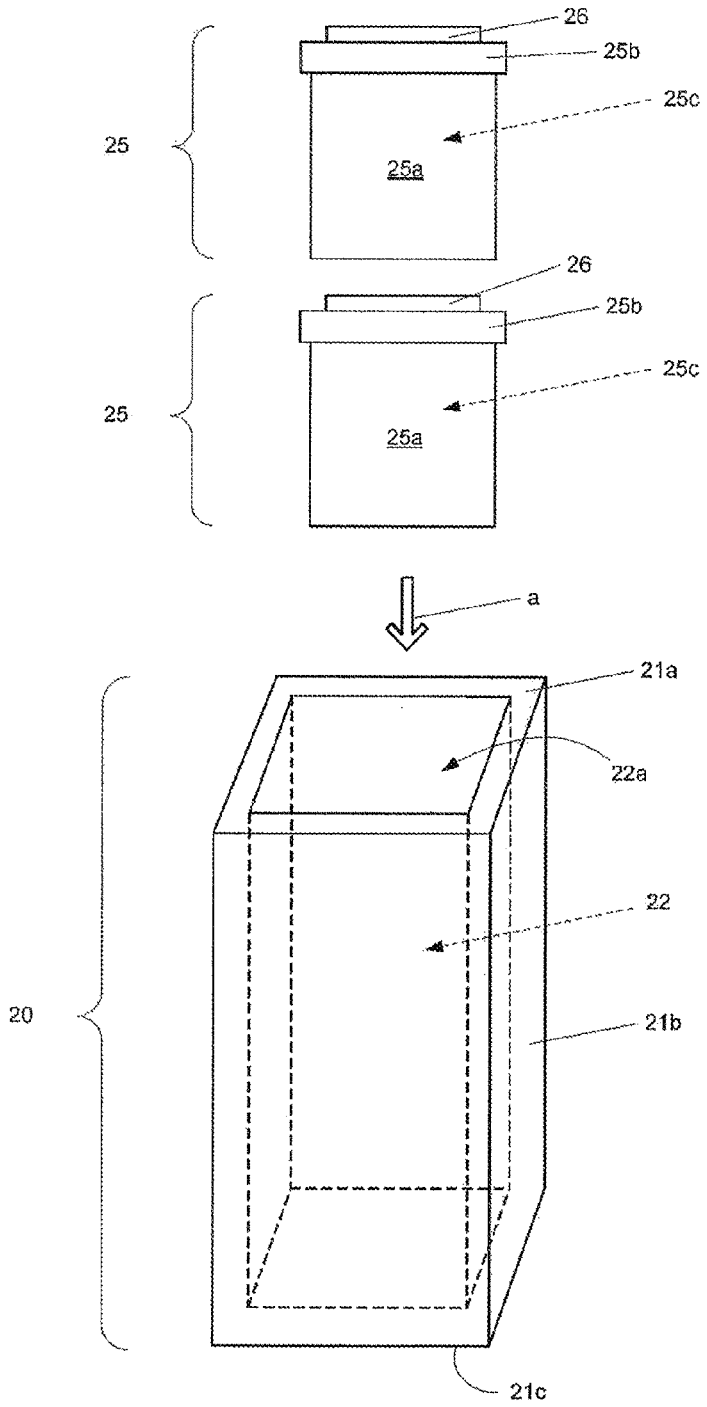
FIG. 3 is an exploded parts view of another central core and a pair of vessels of the memorial urn, in accordance with another embodiment of the invention.

Although described above as including generally cylindrical components, other embodiments which include different shapes are also contemplated, as evidenced by FIG. 3. To this end, one or more of the core body 20, the elongated channel 22 the vessel(s) 25 and the outer body 40 (described below) can include any number of different shapes and dimensions.

As shown in FIGS. 4A-4D, the memorial urn 10 can further include a protective and/or decorative outer shell 40 within which the central core 20 can reside. The outer shell can include any number of different shapes and dimensions, and can further include any number of indicia 41.

In one embodiment, the outer shell 40 can include an elongated, generally hollow member having a top end 43 and an opening 49 along the bottom end having a connector 49*a*, such as the illustrated threaded elements, for example, that can engage a complementary connector on the base unit 50 described below. In either instance, the opening 49 can include a shape and size that is sufficient to allow the shell to receive and encompass the above described core 20 (see arrow b).

As shown, any number of commemoratory items such as an engraved plaque 31 and/or images such as a photograph 32, for example, can be affixed to the outer shell 40. As described herein, the plaques can include any type of materials such as bronze, gold plated metal, glass, and/or acrylic, for example. In the preferred embodiment, each of the images and/or plaques can be secured to the outer shell in a non-permanent manner utilizing connectors such as hook and loop material, double sided tape, and the like. Of course, other embodiments are also contemplated wherein the items can be permanently adhered thereon utilizing materials such as glue and resin, for example. A candleholder opening 43*a* can also be disposed along the top end of the device in order to receive a candle and to allow the label 26 of the central core 20 to remain visible when no candleholder is inserted.

As shown, the outer shell 40 can also include one or more lights 48 which can function to illuminate portions of the shell, the plaque 31 and/or the image(s) 32. The lights can preferably be powered by one or more batteries (not illustrated) and can be controlled by a switch 44 that can be positioned anywhere along the Urn. As described herein, the lights can include any form of illumination device such as incandescent bulbs, and/or light-emitting-diodes (LED), for example, having any number of different colors, and can include functionality so as to flash, perform a chasing pattern and/or or remain illuminated, based on an instruction from the switch. Alternatively, the lights can be powered by an AC outlet via a cord (not illustrated).

By providing one or more removable commemorative items along the outer shell, a user can easily constantly change the appearance of the Urn. For example, during the holiday season, the user can replace a formal photograph of their loved one with a holiday picture.

As described herein, the term "indicia" can include any type of decorative elements such as colors, markings, words, shapes, symbols, logos, designs, lights, types of materials, texturing of materials, patterns, images, lithographs and/or additional photographs, for example, this indicia can be provided in accordance with known techniques and can be inlaid onto the main body 40 or can be raised/protruding outward from the outer body 40, so as to give a three dimensional effect.

The memorial urn 10 can also include a candleholder 45 having a protruding bottom portion 45*a* that has a complementary shape and dimension to the shape and dimension of the opening 43*a*. The candleholder 45 further including a generally hollow central portion having any number of different shapes and sizes suitable for receiving any number of conventional candles 5 such as a tea light candle, for example, and can preferably be constructed from a strong, generally fireproof/fire resistant material such as steel or aluminum, for example.

In one embodiment, an audio device 42 such as an MP3 player, or other such voice recorder can be provided onto the outer shell and/or the base unit so as to allow a user to load a stored voice message or favorite song from a loved one. Digital media players such as an MP3 player are extremely well known in the art.

Figure 4A:
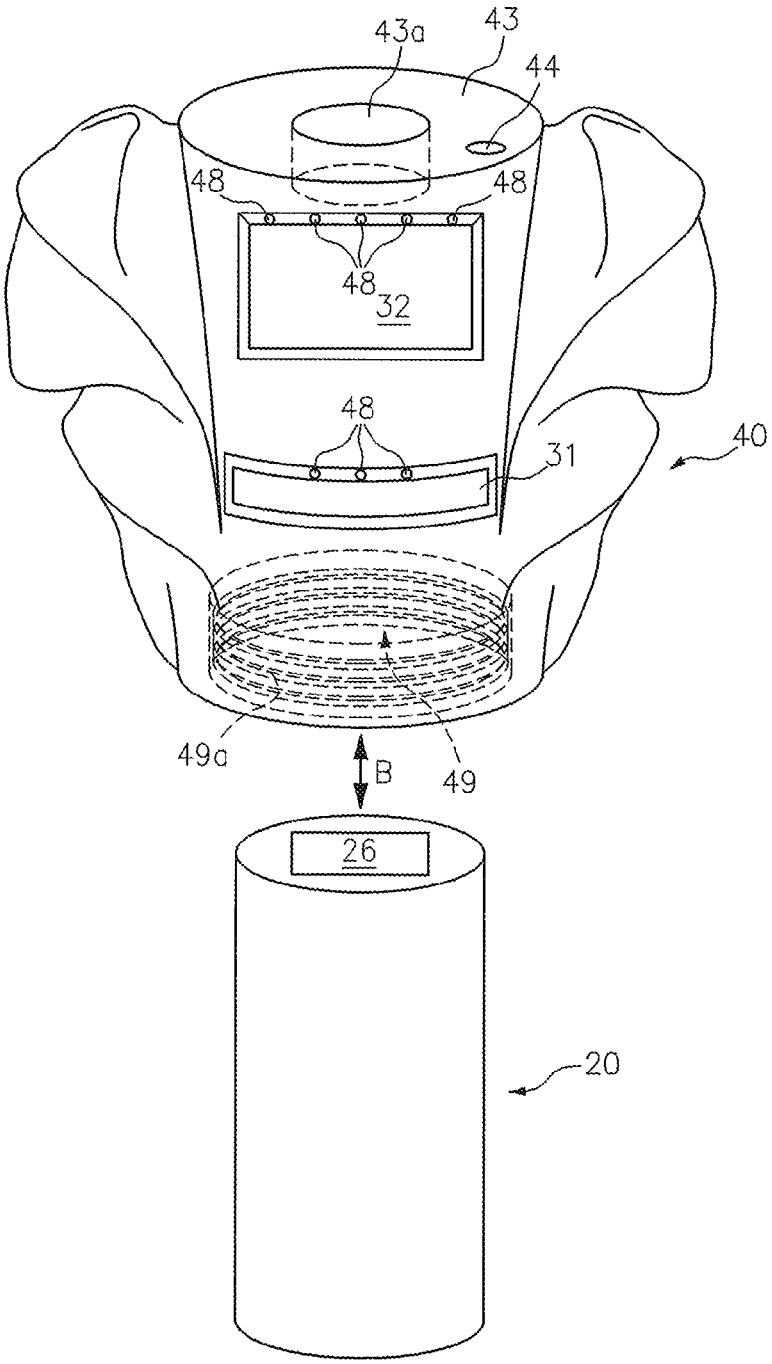
FIG. 4A is an exploded parts view of the memorial urn, in accordance with one embodiment of the invention.
Figure 4B:
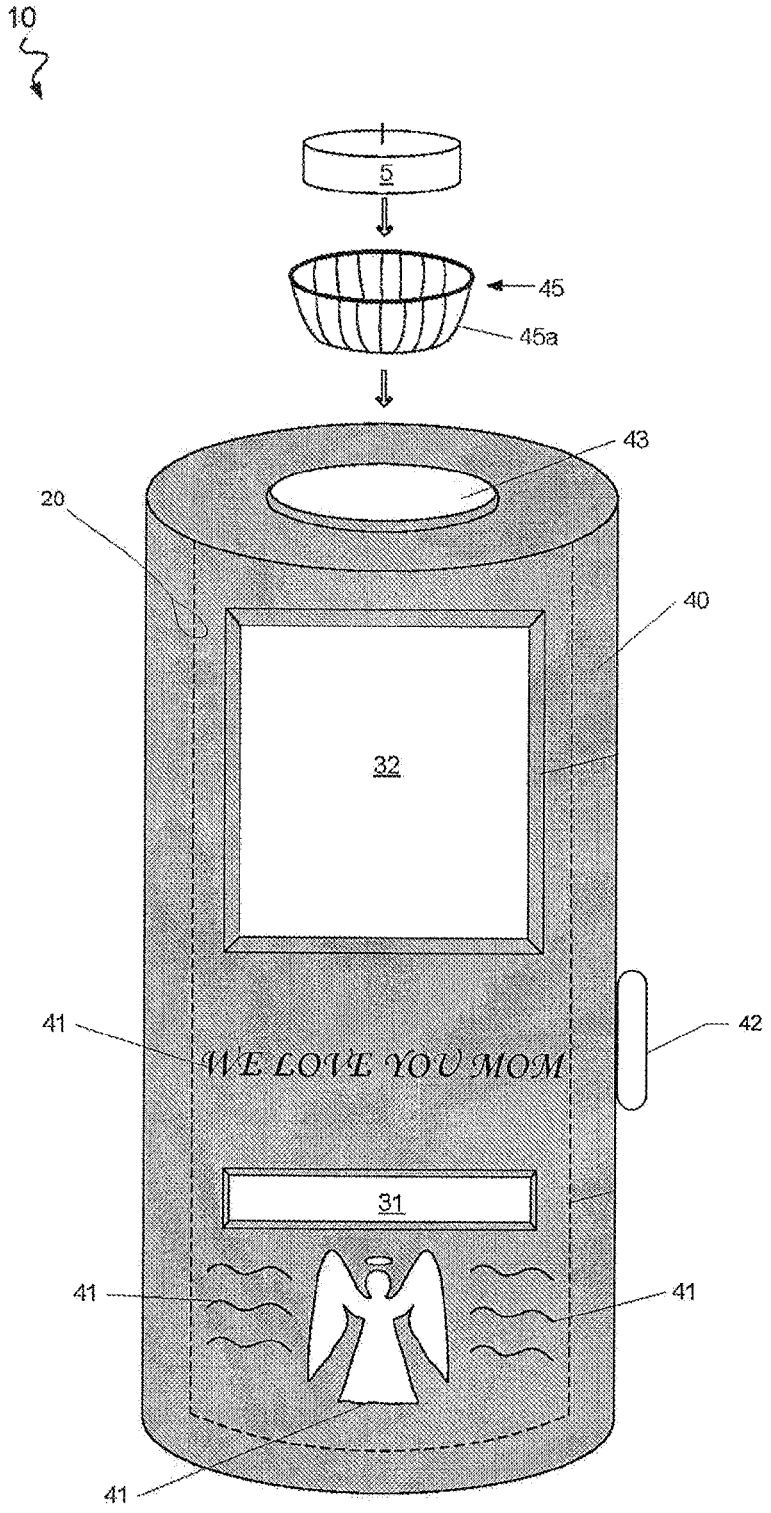
FIG. 4B is a front side view of the memorial urn, in accordance with one embodiment of the invention.
Figure 4C:
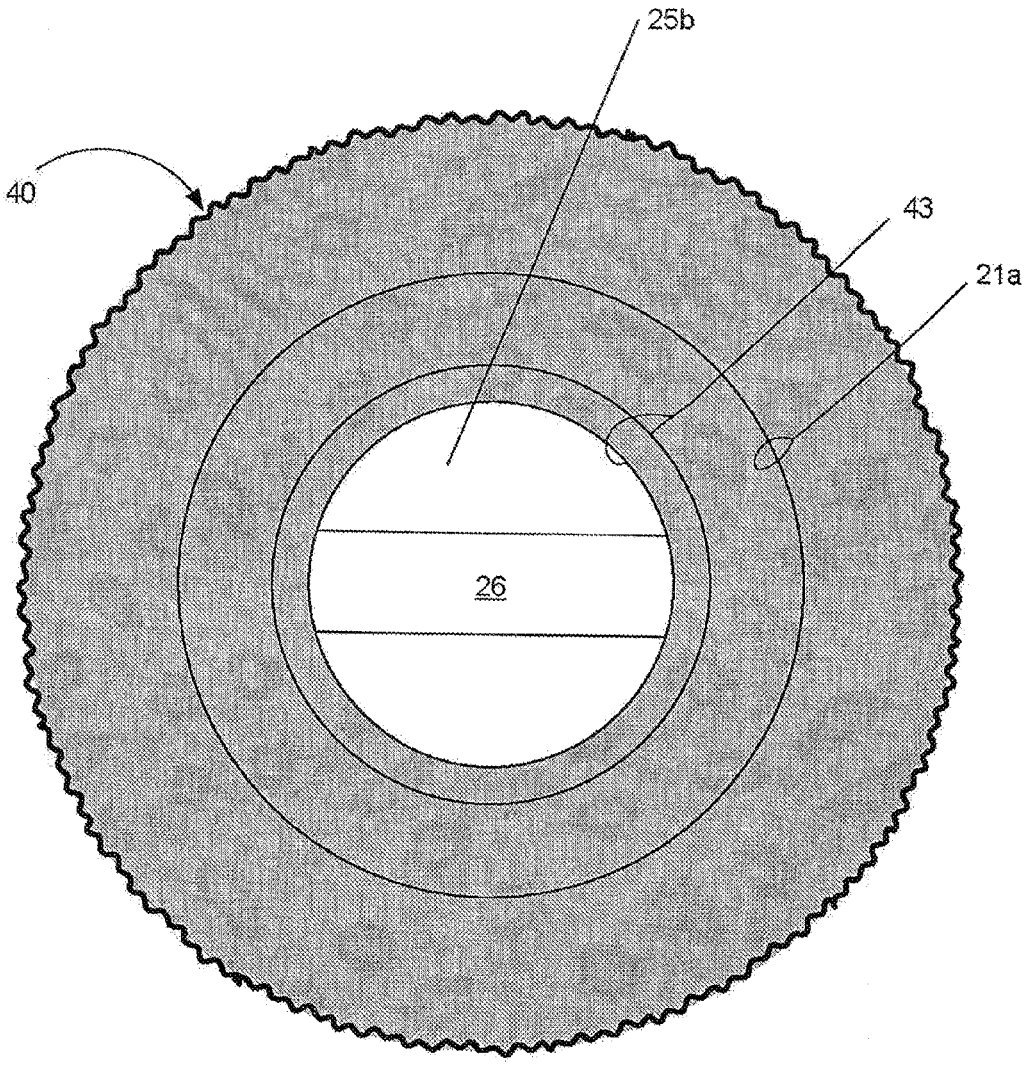
FIG. 4C is a top view of the memorial urn, in accordance with one embodiment of the invention.
Figure 4D:
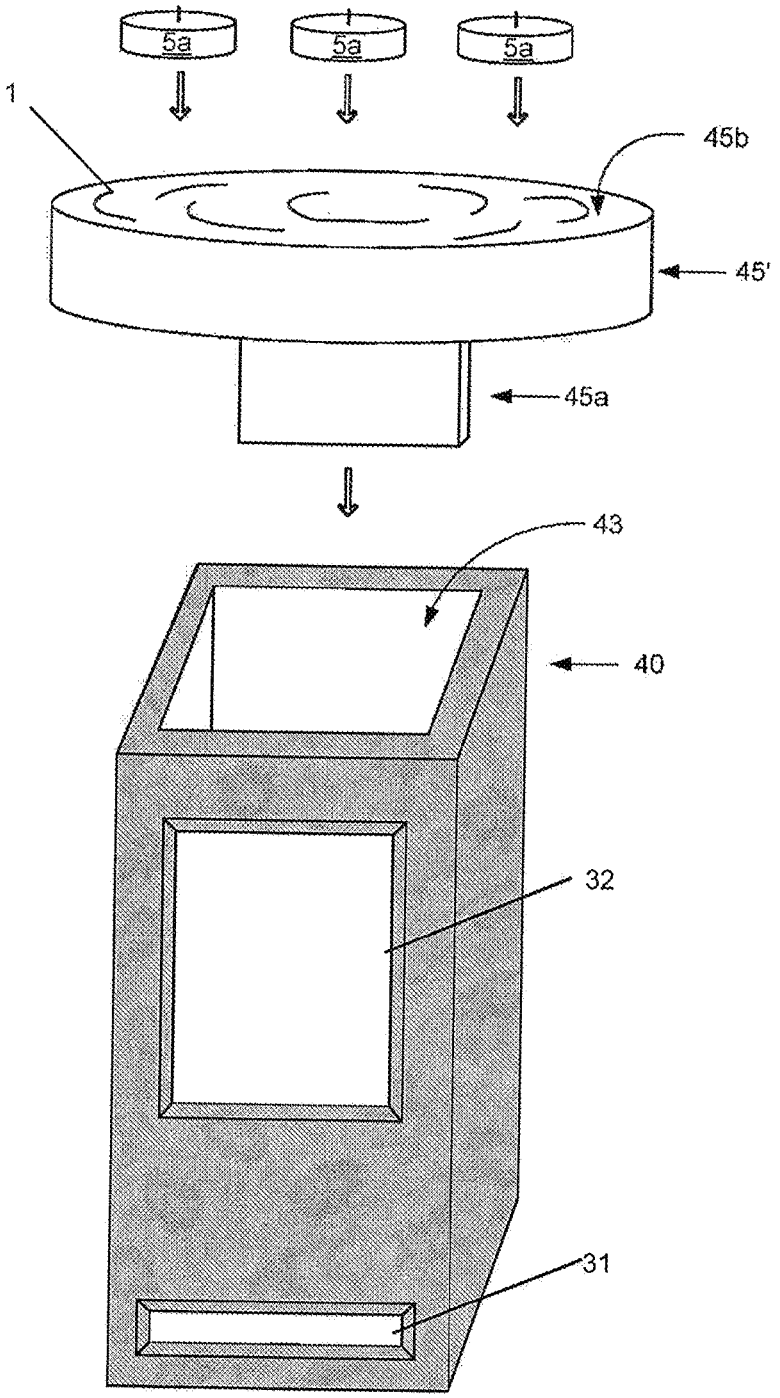
FIG. 4D is an exploded parts view of the memorial urn, in accordance with another embodiment of the invention.

As shown best in FIG. 4D, the candleholder can also be constructed to include a large waterproof body 45*b* capable of receiving and holding water 1. In this manner, the "lagoon" candleholder 45' can function to receive a plurality of floating candles 5*a*, thereby further enhancing the memorial. The lagoon candleholder preferably including a glass or clear plastic construction to enable viewing of the water 1 and/or floating candles 5*a* from an angle.

By positioning a separate fire resistant holder 45 between the outer body 40, the central core 20 and the vessel 30, the memorial urn 10 advantageously functions to direct any heat produced from the candle away from the urn 10. Moreover, the combination of a standard removable wax candle 5 and a fireproof candleholder 45 can be particularly beneficial in instances where a user forgets to extinguish a burning candle before leaving the memorial urn unattended. To this end, the candleholder 45 can continue to direct heat away from the device until the candle self-extinguishes, thereby preventing damage to the urn.

Figure 5:
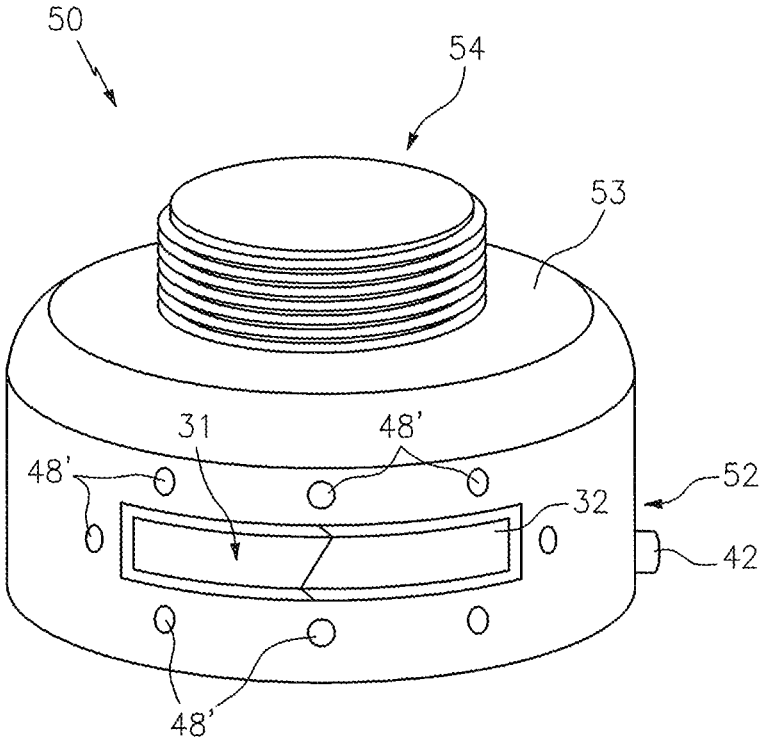
FIG. 5 is a front view of the base unit of the memorial urn, in accordance with one embodiment of the invention.

As shown in FIG. 5, the memorial urn 10 can further include a base unit/pedestal onto which the outer shell 40 and/or the central core 20 can be connected. In one embodiment, the base unit 50 can include a generally rectangular member having a bottom end 51, a middle section 52, a top end 53, and a connector 54, such as the illustrated threaded elements for engaging the connector 49*a* located on the bottom of the outer shell 40. Additionally, the base unit can further include one or more commemoratory items 31 and/or 32, for example, and base lights 48'.

As described herein, the terms "connector," "complementary connector" and derivatives thereof can include any number of different elements capable of repeatedly securing two items together in a nonpermanent manner. Several nonlimiting examples include opposing strips of hook and loop material (i.e. Velcro®), magnetic elements, tethers such as straps and ties, and compression fittings such as hooks, snaps, buttons and threaded elements designed to engage via a twisting motion, for example. Each illustrated connector can be permanently secured to, or incorporated into the design of, the illustrated portion of the device via known manufacturing techniques, a permanent sealer such as glue, adhesive tape, or stitching, for example.

Additionally, each of the base lights 48' can function to illuminate portions of the base unit 50 and/or the outer shell 40. The base lights can preferably be powered by one or more batteries (not illustrated) and can be controlled by a switch that can be positioned anywhere along the base unit. As described herein, the lights 48' can include the same form and type of lights described above with respect to 48.

Figure 6:
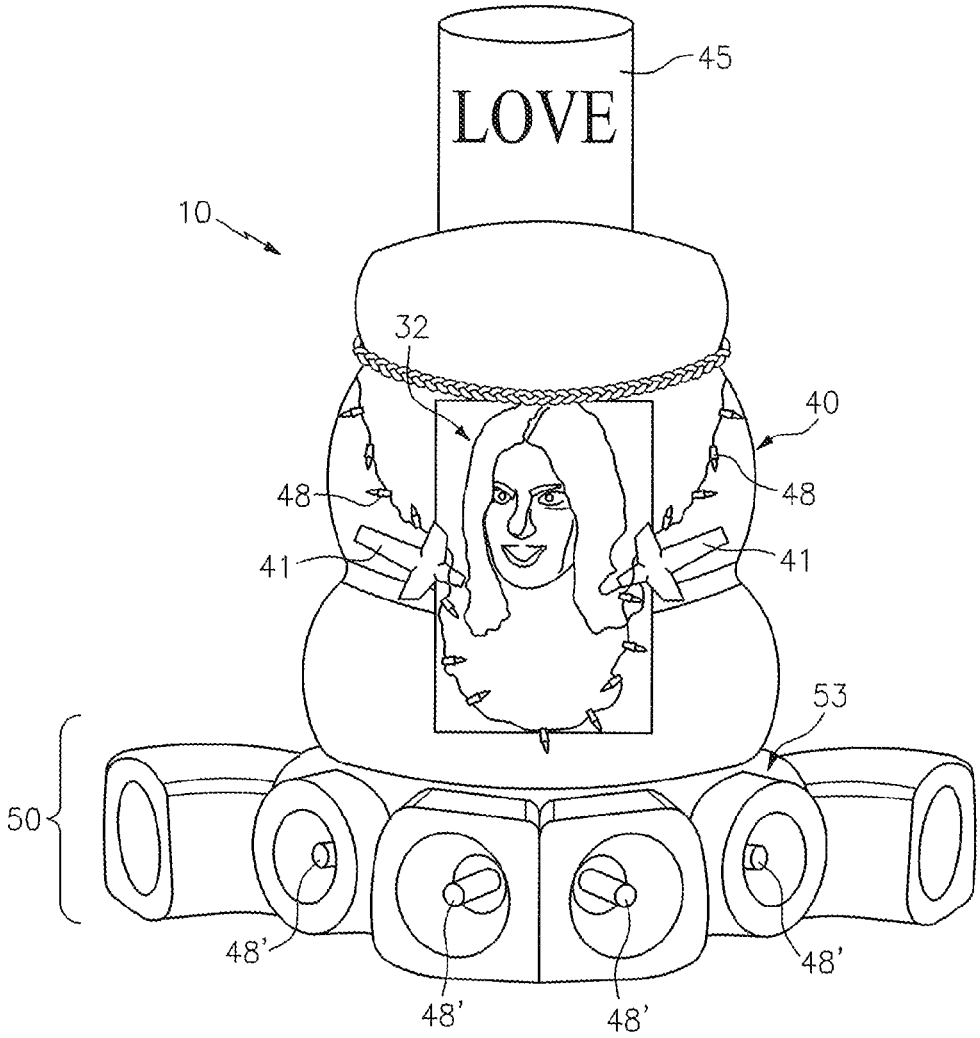
FIG. 6 is a perspective view of another memorial urn in accordance with one embodiment of the invention.

Although described above as including a particular shape and/or construction material, this is for illustrative purposes only, as the base unit 50 can be constructed from any number of suitable materials, can include any number of different shapes and dimensions, and can also include any number of indicia. Moreover, by utilizing connectors and complementary connectors, the base unit 50 and the outer shell 40 can be interchangeable in nature, so as to allow a user to change the appearance of the Urn. To this end, FIG. 6 illustrates another fully assembled urn 10 having a fanciful base unit 50 and outer body 40.

As described herein, one or more elements of the memorial urn 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that any number of different individual elements may be formed together as one continuous element, either through manufacturing processes, such as welding, casting, or molding, or through the use of a singular piece of material milled or machined with the aforementioned components forming identifiable sections thereof.

Additionally, the memorial urn 10 as described above can be attached to or secured within any number of other products, such as a rocking chair, a grandfather clock, a mantle or other such fixture through any known connection means such as a bracket, for example. Accordingly, the memorial urn 10 is not to be construed as only a standalone embodiment.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A memorial urn for storing cremated remains, said urn comprising:

a central core having an elongated, generally hollow channel disposed therein;

a core opening disposed along a top end of the central core, said opening being in communication with the hollow channel;

a vessel disposed within the elongated hollow channel, said vessel having an airtight and waterproof chamber that is configured to receive and store the cremated remains, and including a permanent identification marking thereon;

an outer shell that is removably positioned about the central core, said shell including one or more commemoratory items that are removably secured thereon;

a base unit that is removably secured to the outer shell;

a candleholder opening that is disposed along an upper portion of the outer shell at a location in line with the permanent identification marking; and a generally fire resistant candleholder that is configured to be positioned within the candleholder opening, and including a shape that is conducive for receiving a candle and to direct any heat produced from the candle away from the urn.

2. The memorial urn of claim 1, further comprising:

one or more lighted elements that are disposed along the outer shell.

3. The memorial urn of claim 1, further comprising:

one or more lighted elements that are disposed along the base unit.

4. The memorial urn of claim 1, wherein the central core and the outer shell include different shapes.

5. The memorial urn of claim 1, wherein the outer shell and the base unit include different shapes.

6. The memorial urn of claim 1, wherein the central core is constructed from a fireproof and scatter proof material.

7. The memorial urn of claim 1, wherein the identification marking is visible via the central core opening.

8. The memorial urn of claim 1, wherein the identification marking is visible via each of the core opening and the candleholder opening.

9. The memorial urn of claim 1, further comprising:

one or more commemoratory items located on the base unit.

10. The memorial urn of claim 1, further comprising:

a pair of connectors and complementary connectors disposed along the outer shell and the base unit, respectively, said connectors and complementary connectors being configured to engage the outer shell and base unit in a non-permanent manner.

11. The memorial urn of claim 10, wherein said commemoratory items include one of a plaque and a photograph.

12. The memorial urn of claim 1, wherein said commemoratory items include one of a plaque and a photograph.

13. The memorial urn of claim 1, wherein said commemoratory items include each of a plaque and a photograph.

14. The memorial urn of claim 1, wherein said identification marking comprises at least one of a label that is permanently adhered to the vessel, and an engraving onto a surface of the vessel.

15. The memorial urn of claim 1, wherein said vessel is configured to be permanently sealed upon receipt of the cremated remains.

16. The memorial urn of claim 1, further comprising a plurality of vessels, each secured within the elongated channel of the central core.

17. The memorial urn of claim 1, wherein the base unit is interchangeable between a plurality of different outer shells.

18. A memorial urn for storing cremated remains, said urn comprising:

a central core having an elongated, generally hollow channel disposed therein;

a core opening disposed along a top end of the central core, said opening being in communication with the hollow channel;

a vessel disposed within the elongated hollow channel, said vessel having an airtight and waterproof chamber that is configured to receive and store the cremated remains, and including a permanent identification marking thereon;

an outer shell that is removably positioned about the central core, said shell including one or more commemoratory items that are removably secured thereon;

a base unit that is removably secured to the outer shell;

a candleholder opening that is disposed along an upper portion of the outer shell at a location in line with the permanent identification marking; and a lagoon candleholder having a waterproof body configured to receive and hold water and a plurality of floating candles, said lagoon candleholder being configured to be inserted within the candleholder opening.

* * * * *